US006589095B1

(12) United States Patent
Tsai

(10) Patent No.: US 6,589,095 B1
(45) Date of Patent: Jul. 8, 2003

(54) MOVABLE MECHANICAL DOLL

(76) Inventor: Chih-Cheng Tsai, No. 13, Chung Hwa Rd., Lin Lo Village, Lin Lo Hsiang, Pingtung Hsien (TW)

( * ) Notice: Subject to any disclaimer, the term of this patent is extended or adjusted under 35 U.S.C. 154(b) by 0 days.

(21) Appl. No.: 10/177,172

(22) Filed: Jun. 20, 2002

(30) Foreign Application Priority Data

Apr. 30, 2002 (TW) ..... 91205955 U

(51) Int. Cl.[7] ..... A63H 11/00; A63H 13/00; A63H 3/20

(52) U.S. Cl. ..... 446/330; 446/338; 446/354

(58) Field of Search ..... 446/330, 300, 446/335, 338, 352, 353, 354, 391, 395

(56) References Cited

U.S. PATENT DOCUMENTS 1,576,789 A * 3/1926 Robertson
3,672,096 A * 6/1972 Johmann
3,964,205 A * 6/1976 Kuramochi
4,869,703 A * 9/1989 Ong ..... 446/353
4,911,676 A * 3/1990 Fan ..... 446/300
5,695,382 A * 12/1997 Lin ..... 446/354

* cited by examiner

*Primary Examiner*—Derris H. Banks
*Assistant Examiner*—Ali Abdelwahed
(74) *Attorney, Agent, or Firm*—Dellett and Walters

(57) ABSTRACT

A movable mechanical doll has a seat. A shoulder-arm part and a head part (40) are mounted on the seat. A hollow body covers the seat and the shoulder-arm part (20). A headpiece (60) covers the head part (40) and has a mouth. When motors of the doll are actuated, the doll can swing the shoulders and the arms, turn the head and open/close the mouth.

8 Claims, 8 Drawing Sheets

MOVABLE MECHANICAL DOLL

BACKGROUND OF THE INVENTION

1. Field of the Invention

The present invention is related to a movable mechanical doll, and more particularly to a doll that has movable shoulders and arms driven by a mechanism and motors.

2. Description of Related Art

Dolls have been a favorite toy for thousands of years. In conventional dolls, movable mechanical dolls are much more interesting than static dolls, because these movable mechanical dolls have movable body parts and can sing and speak. However, there is no mechanical doll that can move its shoulders and arms.

Therefore, the invention provides an improved movable mechanical doll to mitigate and/or obviate the aforementioned problems.

SUMMARY OF THE INVENTION

The main objective of the invention is to provide a movable mechanical doll that has movable shoulders and arms.

Another objective of the invention is to provide a movable mechanical doll that has a mouth which can be opened and closed.

Other objects, advantages and novel features of the invention will become more apparent from the following detailed description when taken in conjunction with the accompanying drawings.

DETAILED DESCRIPTION OF THE PREFERRED EMBODIMENT

Figure 1:
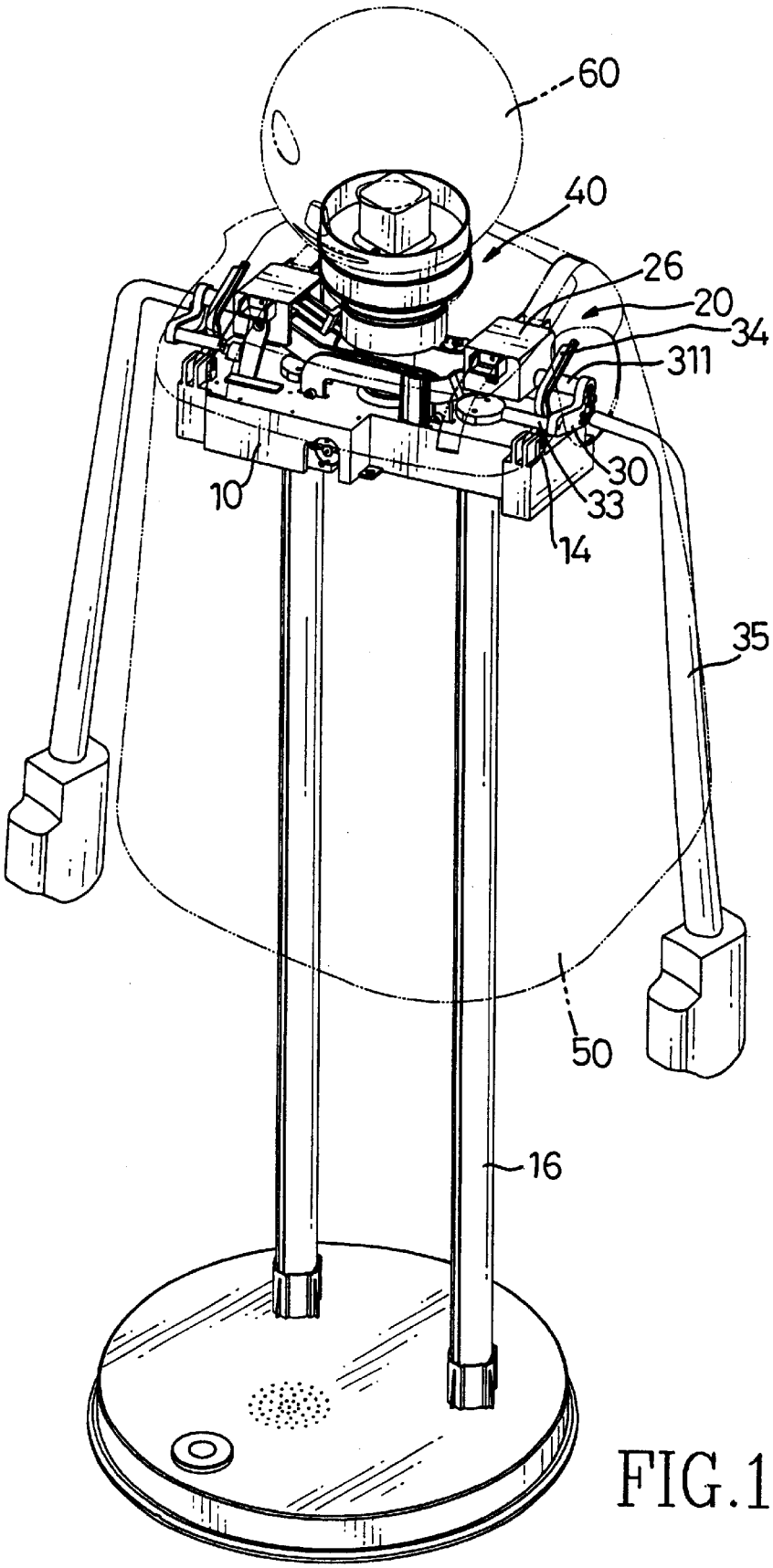
FIG. 1 is a perspective view of a movable doll in accordance with the invention.
Figure 2:
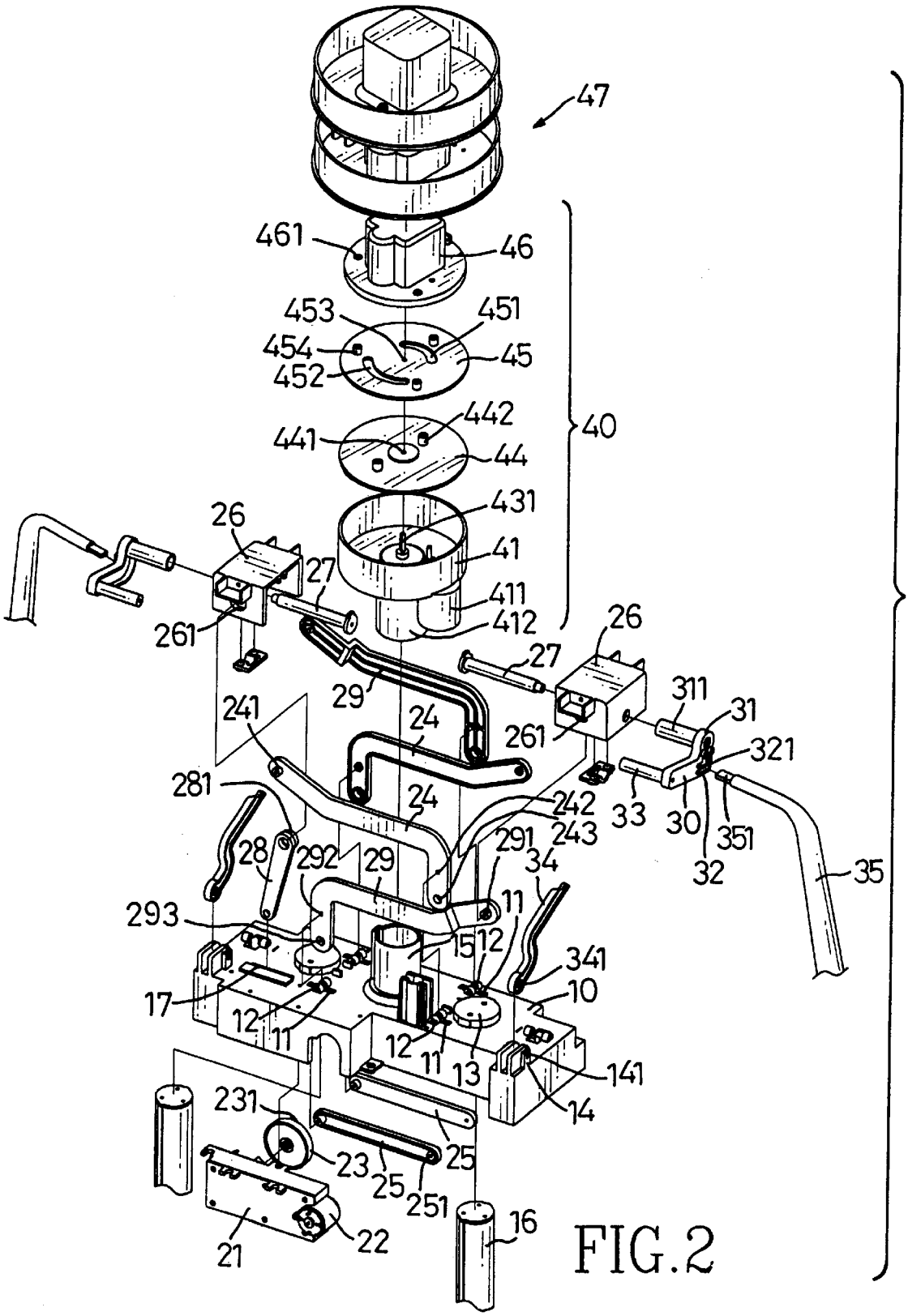
FIG. 2 is an exploded perspective view of the movable doll of the invention.

Referring to FIGS. 1 and 2, a movable mechanical doll in accordance with the invention is composed of a seat (10), a shoulder-arm part (20), a head part (40), a hollow body (50) covering the seat (10) and the shoulder-arm part (20), and a headpiece (60) covering the head part (40).

The seat (10) has a plurality of apertures (11) defined therein and a plurality of pivoting members (12) respectively provided at the apertures (11). A pair of ears (14) is formed at two sides of a front edge of the seat (10) and each of the ears (14) has a pivot opening (141) defined therethrough.

A first tube (15) is formed at a center of the seat (10). Two second tubes (13) are respectively formed at two sides of the first tube (15). Two legs (16) are respectively inserted in the second tubes (13) and extend downwards, and a bottom seat (not numbered) provided at a bottom of the legs (16). A slot (17) is transversally defined at a left side of the seat (10), and a swing rod (28) is extended through the slot (17).

The shoulder-arm part (20) has a first gear box (21) mounted in the seat (10). A wheel (23) is engaged with gears (not shown or numbered) in the first gear box (21) and has a first pivot pin (231) provided adjacent an outer periphery thereof. The swing rod (28) is pivotally mounted on the wheel (23) by the first pivot pin (231) inserted through a first end thereof. A first motor (22) is provided in the first gear box (21) for driving the gears.

Two pairs of link assemblies, each being composed of a first L-shaped link (24) and a second L-shaped link (29) combined together, are mounted on the seat (10). In the first link assemblies, the second L-shaped link (29) is in front of the first L-link (24), and in the second link assemblies, the first L-shaped link (24) is in front of the second L-link (29). The first L-shaped links (24) each have a first upper pivot pin (241) defined at a distal end of a long arm thereof, a first lower hole (243) defined at a distal end of a short arm thereof, and a first middle hole (242) defined above the lower hole (243). The second L-shaped links (29) each have a second upper pivot pin (291), a second middle hole (292) and a second lower hole (293) corresponding to the first pivot pin (241) and the respective first holes (242, 243).

The short arms of the links (24, 29) are respectively extended through the apertures (11) and pivotally mounted on the seat (10) by the pivoting members (12) inserted through the middle holes (242, 292).

A pair of lower linkages (25) is mounted in the seat (10) and has two second pivot pins (251) respectively provided at two ends thereof. The first link assembly is pivotally mounted on the left end of the lower linkages (25) by the second pivot pin (251) inserted through the lower holes (243, 293) of the first link assembly, and the second link assembly is pivotally mounted on the right end of the right linkages (25) by the second pivot pin (251) inserted through the lower holes (243, 293) of the second link assembly.

Two shoulder joints (26) each have a first pivot hole (261) pivotally mounted with the respective upper pivot pins (241, 291) of the link assemblies by a pivoting member (not numbered). The first link assembly is pivotally mounted with the right shoulder joint (26), and the second link assembly is pivotally mounted with the left shoulder joint (26).

The swing rod (28) has a third hole (281) provided at an upper end thereof and pivotally mounted on the left shoulder joint (26) by the third hole (281) inserted in the first upper pivot pin (241).

Two rotating joints (30) are respectively mounted at an outer aide of the shoulder joints (26). Each of the rotating joints (30) has an L-shaped plate (31). A limit rod (33) and a tubular rod (311) are mounted on the L-shaped plate (31) and parallel to each other. Fastening members (32) are respectively provided at an outer surface of the L-shaped plate (31). Two pins (27) are inserted in the respective shoulder joints (26) and the tubular rods (311) to pivotally mount the rotating joints (30) on the shoulder joints (26).

Two swing poles (34) each have a second pivot hole (341) defined at a lower end thereof and engaged with the respective pivot opening (141) and are pivotally mounted on the ears (14), respectively. The swing poles (34) are located beneath the respective limit rode (33) and above the respective tubular rod (311).

Two arms (35) are respectively provided on the rotating joints (30) and each have a distal end (351) respectively secured in gaps (321) in the fastening members (32). Thus, the arms (35) can be moved along with the rotating joints (30).

Figure 7:
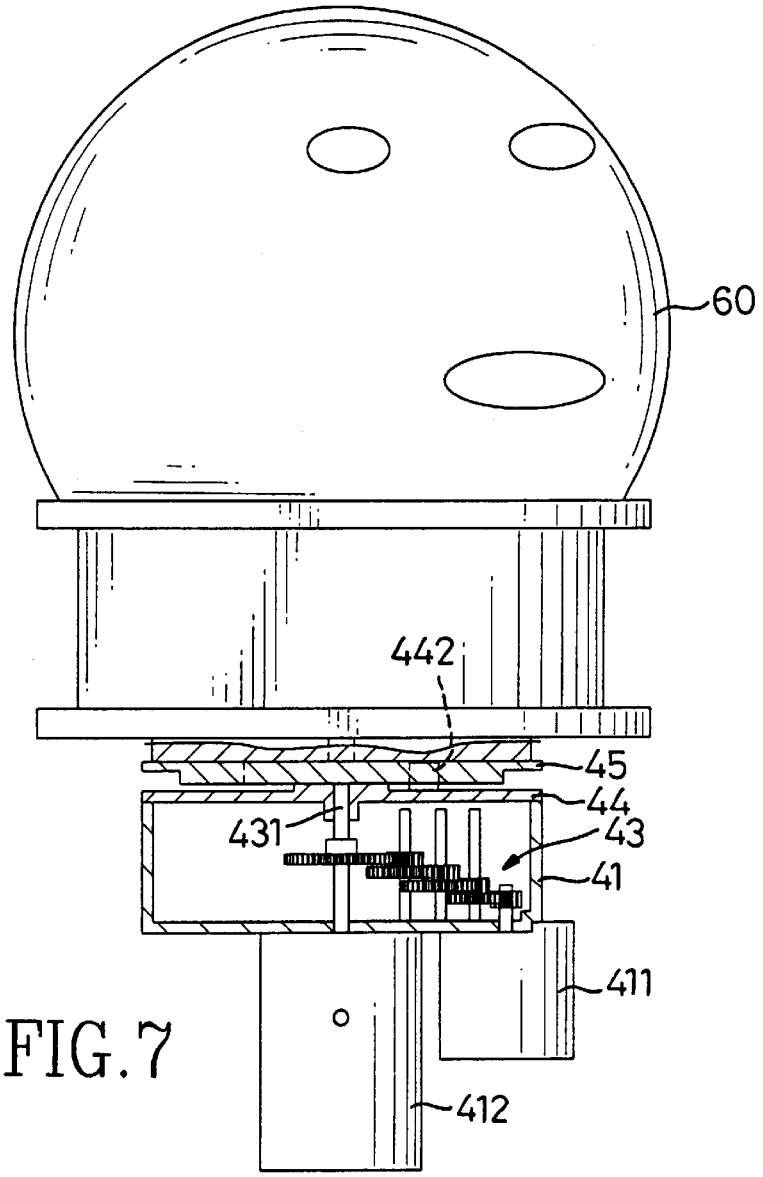
FIG. 7 is a front view showing an action of a head of the doll.

Referring to FIGS. 2 and 7, the head part (40) is mounted on the first tube (15) of the seat (10). The head part (40) has a second gear box (41) having a bottom tube (412) engaged with the first tube (15). An axle (431) is received in the bottom tube (412) of the second gear box (41) and mounted with a series of gears (43) and driven by a second motor (411).

A lower disk (44) is rotatably mounted at a top of the second gear box (41) and has a first central hole (441) defined therethrough. The axle (431) extends through the first central hole (441) of the lower disk (44) and can drive the lower disk (44) to rotate. Two first lugs (442) are formed at diametrically opposite sides of the first central hole (441).

An upper disk (45) is provided above the lower disk (44) and has a second central hole (453) defined therethrough. Two arcuate slots (451, 452) are defined at diametrically opposite sides of the second central hole (453). The axle (431) extends through the second central hole (453) of the upper disk (45). The first lugs (442) extend in the arcuate slots (451, 452). A plurality of second lugs (454) is formed on the upper disk (45) and around the second central hole (453). The upper disk (45) can be rotated along with the lower disk.(44) when the first lugs (442) arrive at ends of the arcuate slots (451, 452).

A head joint (46) is provided above the upper disk (45). A plurality of lug holes (461) is defined through a bottom of the head joint (46) for receiving the second lugs (454) on the upper disk (45). A neck (47) is mounted on the head joint (46).

Figure 3:
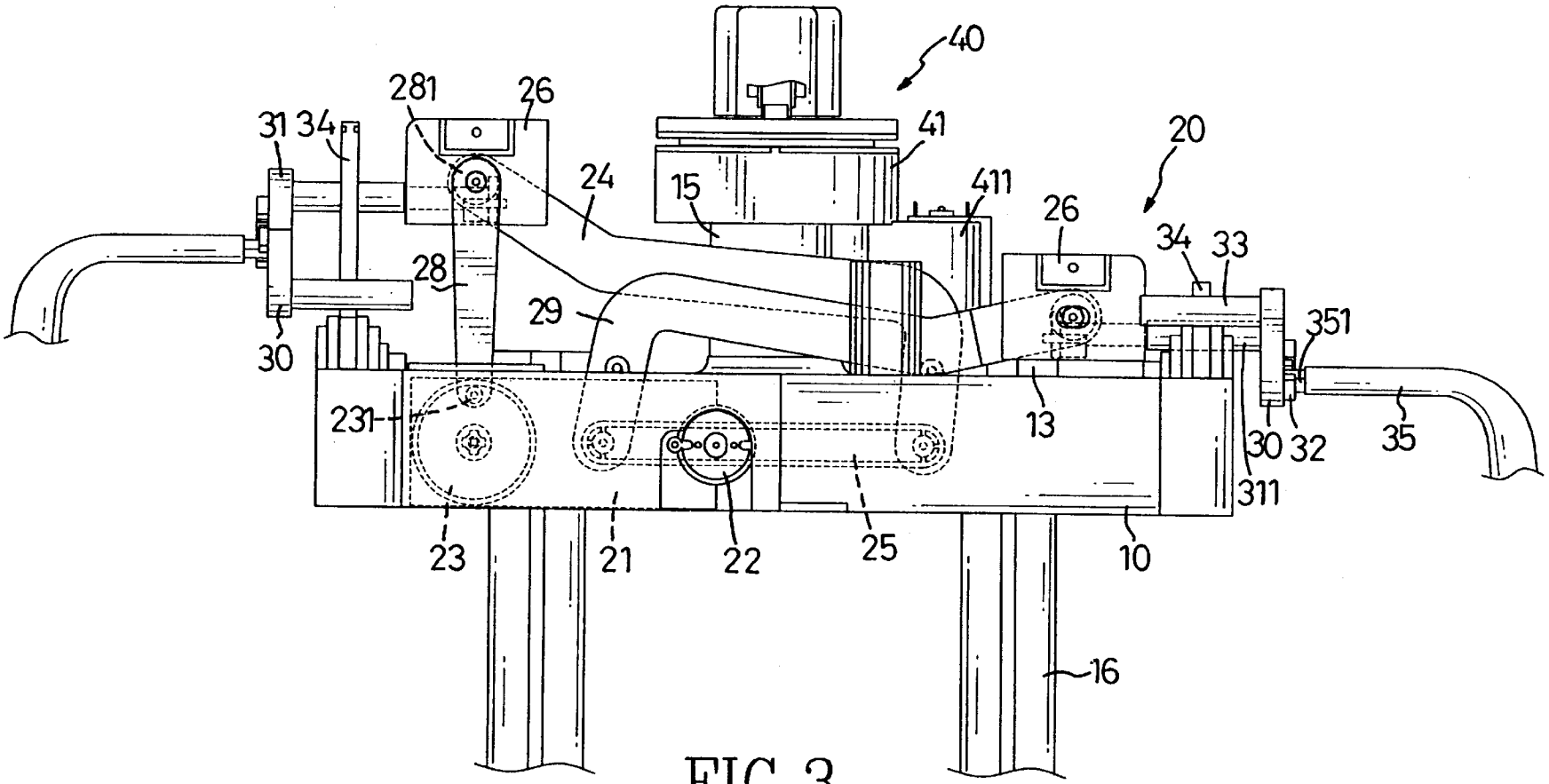
FIG. 3 is a front view showing an action of shoulders of the doll.
Figure 4:
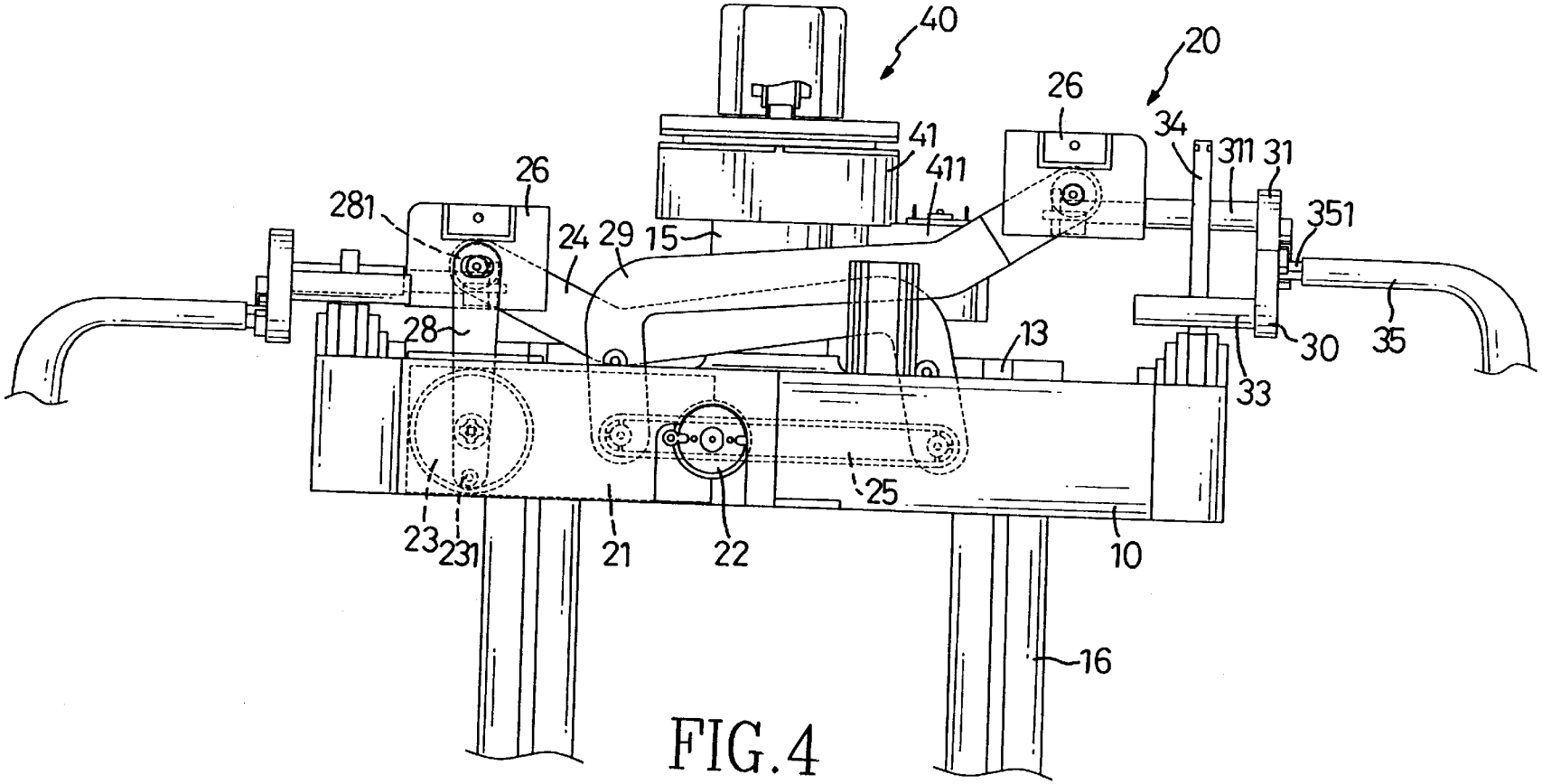
FIG. 4 is a front view showing another action of the shoulders.

Referring to FIGS. 3 and 4, when the first motor (22) is actuated, the wheel (23) is driven to move the swing rod (28). The left shoulder joint (26) connected with the swing rod (28) is moved left and right. The second link assembly is then transversally moved along with the left shoulder joint (26) and the first link assembly is driven to move by the lower linkages (25). The right shoulder joint (26) connected with the first link assembly is moved left and right. Thus, the hollow body (50) mounted on the shoulder joints (26) is moved left and right along with the shoulder joints (26).

Figure 5:
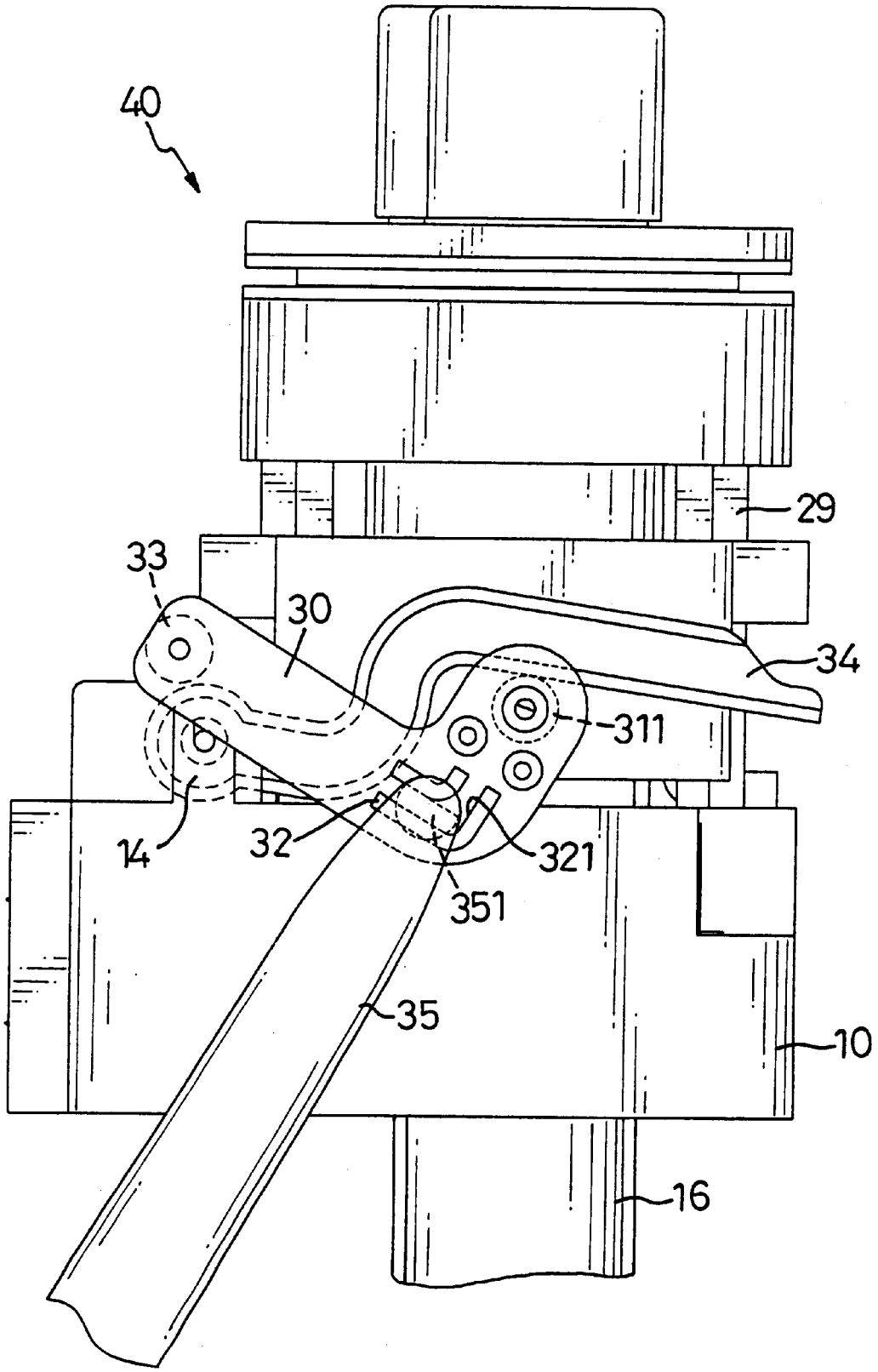
FIG. 5 is a side view showing an action of arms of the doll.
Figure 6:
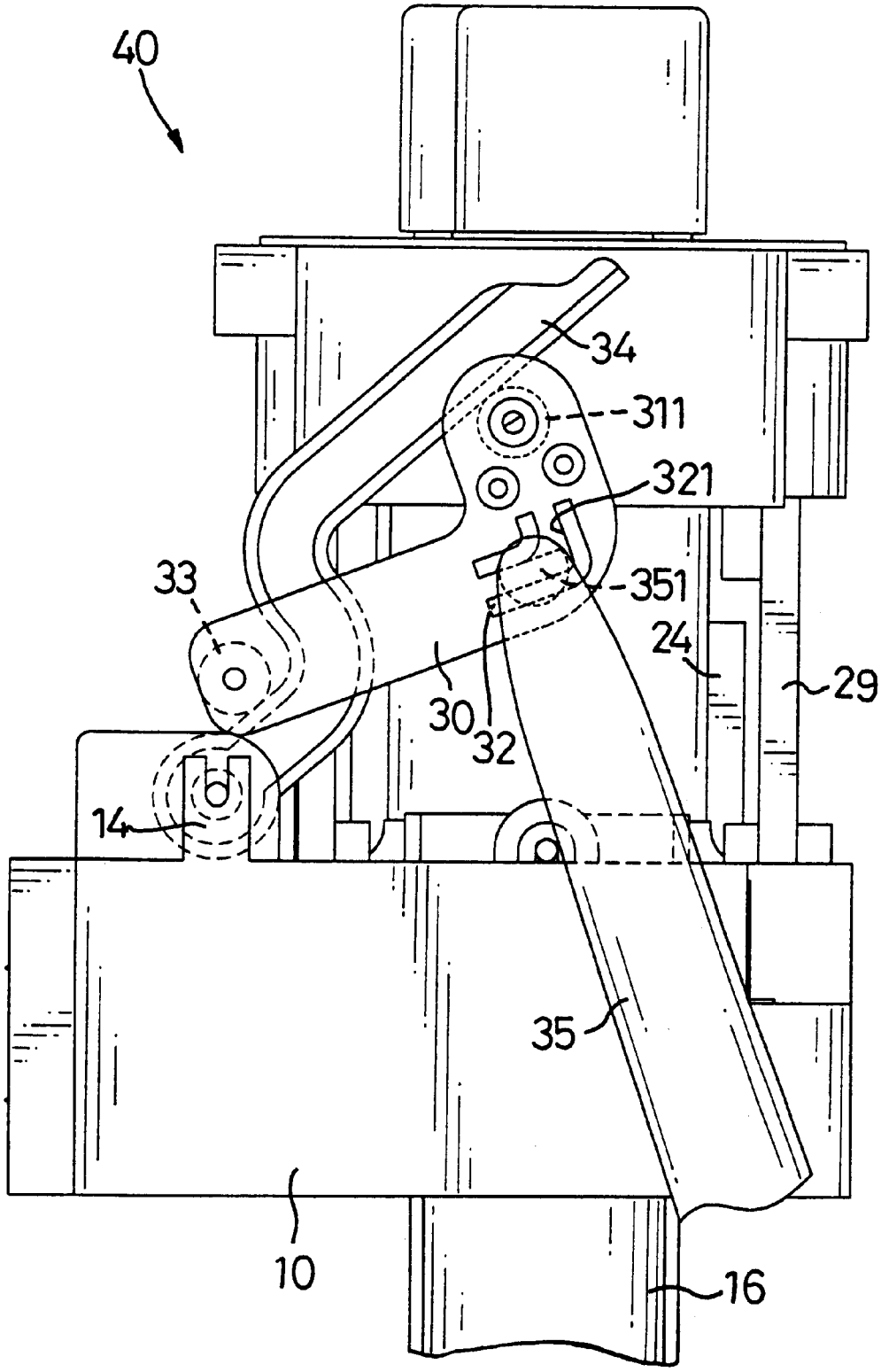
FIG. 6 is a side view showing another action of the arms of the doll.

Referring to FIGS. 5 and 6, when the pins (27) are moved along with the shoulder joints (26), the tubular rods (311) are moved upwards and downwards. Thus, the L-shaped plates (31) are moved forwards and backwards and pivoted about the respective pins (27). The arms (35) on the plates (31) are swung according to the L-shaped plates (31).

Figure 8:
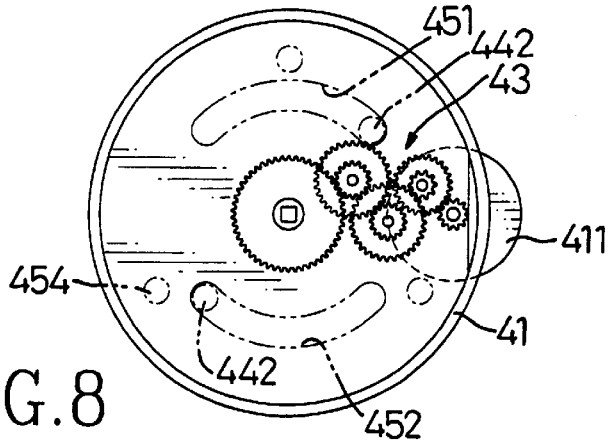
FIG. 8 is a top view showing the action of the head of the doll.

Referring to FIGS. 7 and 8, when the second motor (411) is actuated, the axle (431) is driven by the series of gears (43) to rotate. The lower disk (44) is rotated along with the axle (431). When the first lugs (442) arrive at the ends of the arcuate slots (451, 452), the upper disk (45), the head joint (46) and the neck (47) can be rotated along with the lower disk (44). Therefore, the headpiece (60) mounted on the neck (47) can be rotated.

Figure 9:
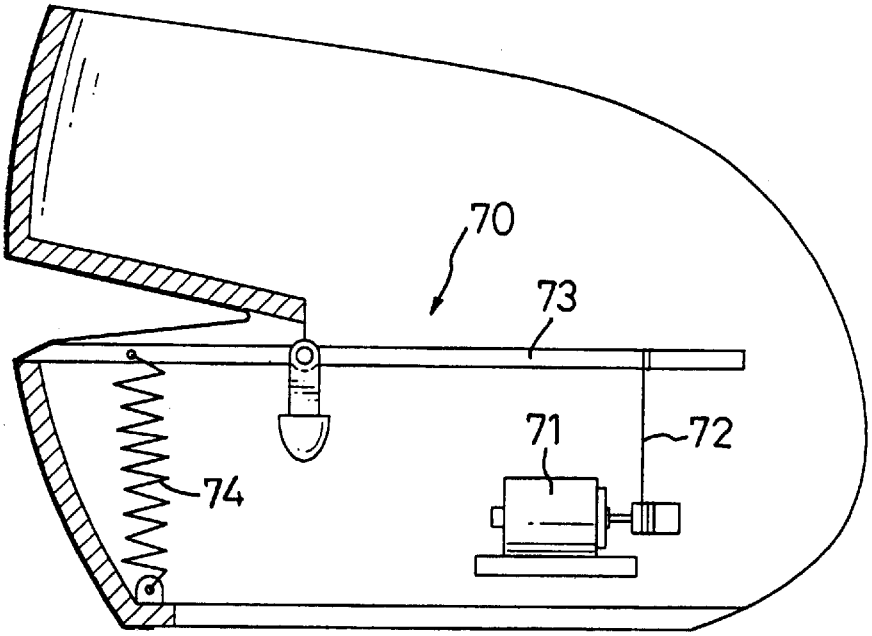
FIG. 9 is a side view showing that a mouth of the head is opened.
Figure 10:
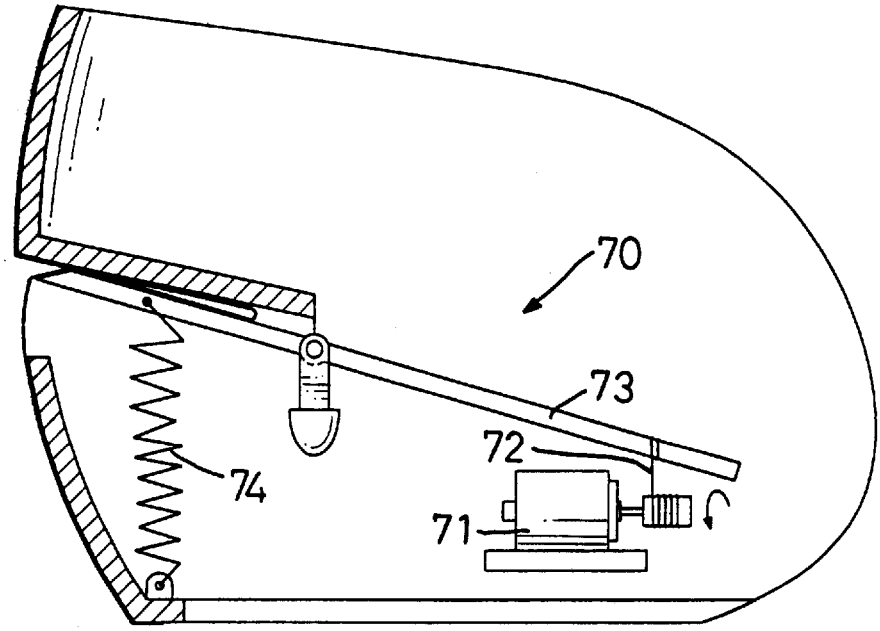
FIG. 10 is a side view showing that the mouth of the head is closed.

Referring to FIGS. 9 and 10, the headpiece (60) has a mouth (not numbered) defined therein and a control device (70) to open the mouth is mounted in the headpiece (60). The control device (70) has a third motor (71), and a dragline (72) attached on an output axle of the third motor (71). A lever (73) is pivotally mounted in the mouth. The dragline (72) is attached with a rear end of the lever (73), and a front end of the lever (73) is combined with a lower lip of the mouth. A resilient member (74) is provided under the front end of the lever (73).

When the third motor (71) is actuated to pull the dragline (72), the mouth is closed, as shown in FIG. 10. When the third motor (71) is actuated to loosen the dragline (72), under the force of the resilient member (74), the mouth is opened.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A movable mechanical doll, comprising:

a seat (10), the seat (10) having a plurality of apertures (11) defined therein, a plurality of pivoting members (12) respectively provided at the apertures (11), a first tube (15) formed at a center of the seat, two second tubes (13) respectively formed at two aides of the first tube, two pairs of ears (14) respectively formed at two sides of a front edge of the seat (10), two legs (16) respectively inserted in the second tubes (13) and extending downwards, a slot (17) transversally defined through the seat (10), a shoulder-arm part (20) installed on the seat (10), the shoulder-arm part (20) having a first gear box (21) mounted therein, a first motor (22) mounted in the first gear box (21), a wheel (23) driven by the first motor (22) and mounted on the first gear box (21), a first pivot pin (231) provided on and adjacent to an outer periphery of the wheel (23), a swing rod (28) extending through the slot (17) and pivotally mounted on the wheel (23) by the first pivot pin (231) inserted through a first end of the swing rod (28), a pair of first and second L-shaped link assemblies each having upper pivot pins (241, 291) defined at upper ends thereof, lower holes (243, 293) defined at lower ends thereof, and middle holes (242, 292) defined above the lower holes (243, 293) and pivotally mounted on the seat (10) by pivoting members (12) inserted in the middle holes (242, 292), a pair of lower linkages (25) mounted on the seat (10) and each having two second pivot pins (251) respectively provided at a left end and a right end of the lower linkages (25), the first link assembly pivotally mounted on the left and right ends of the lower linkage (25) by the second pivot pins (251) inserted through the lower holes (243, 293) of the first link assembly, the second link assembly is pivotally mounted on the left and right ends of the lower linkage (25) by the second pivot pins (251) inserted through the lower holes (243, 293) of the second link assembly, right and left shoulder joints (26) pivotally connected to the respective upper pivot pins (241, 291) of the first and the second link assemblies, wherein the first link assembly is pivotally connected to the right and left shoulder joints (26), and the second link assembly is pivotally connected to the left and right shoulder joints (26), the swing rod (28) having a third hole (281) provided at an upper end thereof and pivotally connected to the left shoulder joint (26) by the upper pivot pin (241) inserted in the third hole (281), two rotating joints (30) respectively mounted at an outer side of the left and right shoulder joints (26), the rotating joints (30) each having an L-shaped plate (31), a limit rod (33) and tubular rod (311) mounted on the L-shaped plate (31), fastening members (32) respectively provided at an outer surface of the L-shaped plate (31), two pins (27) inserted in the respective shoulder joints (26) and the tubular rod (311) to pivotally mount the rotating joints (30) on the left and right shoulder joints (26), two swing poles (34) each having a second pivot hole (341) defined at a lower end thereof, and pivotally mounted on the ears (14) respectively, the swing poles (34) respectively located beneath the limit rods (33) and above the tubular rod (311), two arms (35) respectively provided on the rotating joints (30) and each has a distal end (351) mounted in gaps (321) in the fastening members (32);

a head part (40) mounted on the first tube (15) of the seat (10);

a hollow body covering the seat (10) and the shoulder-arm part (20); and a headpiece (60) covering the head part (40).

2. The movable mechanical doll as claimed in claim 1, wherein the head part (40) has a second gear box (41) having a bottom tube (412) engaged with the first tube (15), an axle (431) received in the bottom tube (412) and mounted with a series of gears (43) and driven by a second motor (411), a lower disk (44) rotatably mounted at a top of the second gear box (41), an upper disk (45) provided above the lower disk (44), the axle (431) extending through the lower disk (44) and the upper disk (45) and driving them to rotate, a head joint (46) provided above the upper disk (45) and a neck (47) mounted on the head joint (46).

3. The movable mechanical doll as claimed in claim 2, wherein the headpiece (60) has a control device (70) mounted therein to open a mouth of the headpiece (60), the control device (70) having a third motor (71), a dragline (72) attached on an output axle of the third motor (71), a lever (73) pivotally mounted in the mouth, the dragline (72) attached with a rear end of the lever (73), a front end of the lever (73) combined with a lower lip of the mouth, and a resilient member (74) provided under the front end of the lever (73).

4. The movable mechanical doll as claimed in claim 1, wherein the first and the second link assemblies each is composed of a first L-shaped link (24) and a second L-shaped link (29) combined together.

5. The movable mechanical doll as claimed in claim 4, wherein the second L-shaped link (29) is in front of the first L-shaped link (24) in the first link assembly, and the first L-shaped link (24) is in front of the second L-shaped link (29) in the second link assembly.

6. The movable mechanical doll as claimed in claim 2, wherein the lower disk (44) has a first central hole (441) defined therethrough, and two first lugs (442) formed at diametrically opposite sides of the first central hole (441).

7. The movable mechanical doll as claimed in claim 6, wherein the upper disk (45) has a second central hole (453) defined therethrough, two arcuate slots (451, 452) defined at diametrically opposite sides of the second central hole (453) to receive the first lugs (442) respectively, and a plurality of second lugs (454) formed thereon and around the second central hole (453).

8. The movable mechanical doll as claimed in claim 7, wherein the head joint (46) has a plurality of lug holes (461) defined through a bottom thereof for receiving the second lugs (454) on the upper disk (45).

* * * * *